US011136509B2

(12) United States Patent
Sivadasan

(10) Patent No.: US 11,136,509 B2
(45) Date of Patent: Oct. 5, 2021

(54) PROCESS FOR MANUFACTURING LUBRICATION BASE OILS

(71) Applicant: UOP LLC, Des Plaines, IL (US)

(72) Inventor: Rajesh Sivadasan, Rijswijk (NL)

(73) Assignee: UOP LLC, Des Plaines, IL (US)

( * ) Notice: Subject to any disclaimer, the term of this patent is extended or adjusted under 35 U.S.C. 154(b) by 146 days.

(21) Appl. No.: 16/574,978

(22) Filed: Sep. 18, 2019

(65) Prior Publication Data

US 2020/0102508 A1 Apr. 2, 2020

Related U.S. Application Data

(60) Provisional application No. 62/737,587, filed on Sep. 27, 2018.

(51) Int. Cl.

| | |
|---|---|
| ***C10G 25/00*** | (2006.01) |
| ***C10G 69/10*** | (2006.01) |
| ***C10G 53/08*** | (2006.01) |
| ***C10M 101/02*** | (2006.01) |
| ***C10G 67/06*** | (2006.01) |

(52) U.S. Cl.

CPC ..... *C10G 25/003* (2013.01); *C10G 53/08* (2013.01); *C10G 67/06* (2013.01); *C10G 69/10* (2013.01); *C10M 101/02* (2013.01); *C10G 2300/201* (2013.01); *C10G 2400/10* (2013.01); *C10M 2203/003* (2013.01)

(58) Field of Classification Search

None

See application file for complete search history.

(56) References Cited

U.S. PATENT DOCUMENTS

| | | | | |
|---|---|---|---|---|
| 5,190,633 A * | 3/1993 | Fetzer | C10G 67/06 208/310 R |
| 2015/0166906 A1* | 6/2015 | Pintar | C10M 101/02 208/58 |
| 2016/0194566 A1 | 7/2016 | Hoo et al. | |

FOREIGN PATENT DOCUMENTS

WO 8805072 A2 7/1988

OTHER PUBLICATIONS

First office action for corresponding GCC Application No. 2019-38367.

* cited by examiner

*Primary Examiner* — Derek N Mueller

(74) *Attorney, Agent, or Firm* — Paschall & Associates, LLC; James C. Paschall

(57) ABSTRACT

Methods and systems for manufacturing lubrication oils are disclosed. In one embodiment, a method for manufacturing a lubrication oil includes the steps of receiving into an adsorber unit an unconverted oil (UCO) feedstock comprising five and six ring polynuclear aromatic (PNA) compounds and contacting the UCO feedstock with an adsorbent to remove PNA compounds, thereby forming a treated UCO feedstock with a low concentration of five and six ring PNAs.

18 Claims, 3 Drawing Sheets

PROCESS FOR MANUFACTURING LUBRICATION BASE OILS

CROSS-REFERENCE TO RELATED APPLICATIONS

This application claims priority from provisional application 62/737,587, filed Sep. 27, 2018, incorporated herein in its entirety.

TECHNICAL FIELD

The present disclosure generally relates to methods and systems for manufacturing lubrication base oils ("lube oils"). More particularly, the present disclosure relates to methods and systems for manufacturing lube oils employing the use of adsorbents to remove polynuclear aromatic compounds.

BACKGROUND

Crude petroleum is distilled and fractionated into many products such as gasoline, kerosene, jet fuel, vacuum gas oil (VGO) and the like. A heavy cut of the crude petroleum may provide the base of lubricating base oils used in, inter alia, the lubrication of internal combustion engines. Lube oil users are demanding ever increasing base oil quality, and refiners are finding that they need to use hydroprocessing to produce base oils that meet these higher quality specifications. New processes and higher severity are required to provide refiners with the tools for preparing high quality modern base oils, particularly using existing equipment at lower cost and with safer operation.

Finished lubricants used for such things as automobiles, diesel engines, and industrial applications generally are comprised of a lube base oil and additives. In general, a few lube base oils are used to produce a wide variety of finished lubricants by varying the mixtures of individual lube base oils of different viscosity grades and individual additives. Typically, lube base oils are simply hydrocarbons prepared from petroleum or other sources. Lube base oils are normally manufactured by making narrow cuts of vacuum gas oils from a crude vacuum tower. The cut points are set to control the final viscosity and volatility of the lube base oil.

In the prior art, Group I base oils, those with greater than 300 ppm sulfur and 10 wt % aromatics have been generally produced by first extracting a vacuum gas oil (or waxy distillate) with a polar solvent, such as N-methyl-pyrrolidone, furfural, or phenol. The resulting waxy raffinates produced from solvent extraction process are then dewaxed, either catalytically with the use of a dewaxing catalyst such as ZSM-5, or by solvent dewaxing to improve cold flow property like pour point. The resultant base oil may be hydrofinished to improve color and other lubricant properties.

Group II base oils, those with less than 300 ppm sulfur and saturates greater than 90%, and with a viscosity index range of 80-120, have been typically produced by hydrocracking followed by selective catalytic dewaxing and hydrofinishing. Hydrocracking upgrades the viscosity index of the entrained oil in the feedstock by ring opening and aromatics saturation. The degree of aromatics saturation is thermodynamic equilibrium limited reaction, thus extent of reaction is limited by hydrogen partial pressure and reaction temperature in hydrocracking stage. In the downstream process, the hydrocracked oil is dewaxed, either by solvent dewaxing or by catalytic dewaxing, with catalytic dewaxing typically being preferred using hydroisomerization dewaxing technology. The dewaxed oil is then preferably hydrofinished at mild temperatures to remove trace olefins and polynuclear aromatics which were may be formed due to acidic nature of the hydrocracking/dewaxing stage and which have a strongly detrimental impact on lube base oil quality.

Group III base oils have the same sulfur and aromatics specifications as Group II base stocks but require viscosity indices above 120. These materials have been manufactured with the same type of catalytic technology employed to produce Group II base oils but with either the hydrocracker being operated at much higher severity, or with the use of very waxy feedstocks.

A typical lube hydroprocessing plant known in the prior art consists of two primary processing stages. In the lead stage, a feedstock, typically a vacuum gas oil, deasphalted oil, processed gas oils, or any combination of these materials, is hydrocracked or solvent extracted. The hydrocracking stage upgrades the viscosity index of the entrained oil in the feedstock by ring opening and aromatics saturation. The degree of aromatics saturation is limited by the high temperature and hydrogen partial pressure of the hydrocracking stage. In a second stage, the hydrocracked oil is dewaxed, preferably with the use of a highly shape-selective catalyst capable of wax conversion by isomerization. The dewaxed oil can be subsequently hydrofinished at mild temperatures to remove aromatics including heavy polynuclear aromatics (HPNAs). HPNAs are polynuclear aromatics (PNAs) having seven or more aromatic rings. HPNAs can affect color of lube oil base stock, so must be removed down to very low levels to be acceptable to lubricating base oil customers.

Accordingly, it is desirable to provide improved apparatuses and processes for the manufacture of high quality lube oils. Additionally, it is desirable to provide such apparatuses and processes that reduces the presence of HPNAs down to acceptable levels and to ensure the lube oil base stock meets color specifications.

BRIEF SUMMARY

The present disclosure is generally a process for manufacturing a lubrication oil, comprising contacting a UCO feedstock with a PNA adsorbent to remove PNA compounds with five and six aromatic rings, thereby providing a treated UCO feedstock with no more than 100 wppm of five and six aromatic rings. The UCO feedstock may also be contacted with an HPNA adsorbent to remove HPNAs.

BRIEF DESCRIPTION OF THE DRAWINGS

The present embodiments will hereinafter be described in conjunction with the following drawing Figure, wherein like numerals denote like elements, and wherein.

DEFINITIONS

Figure 1:
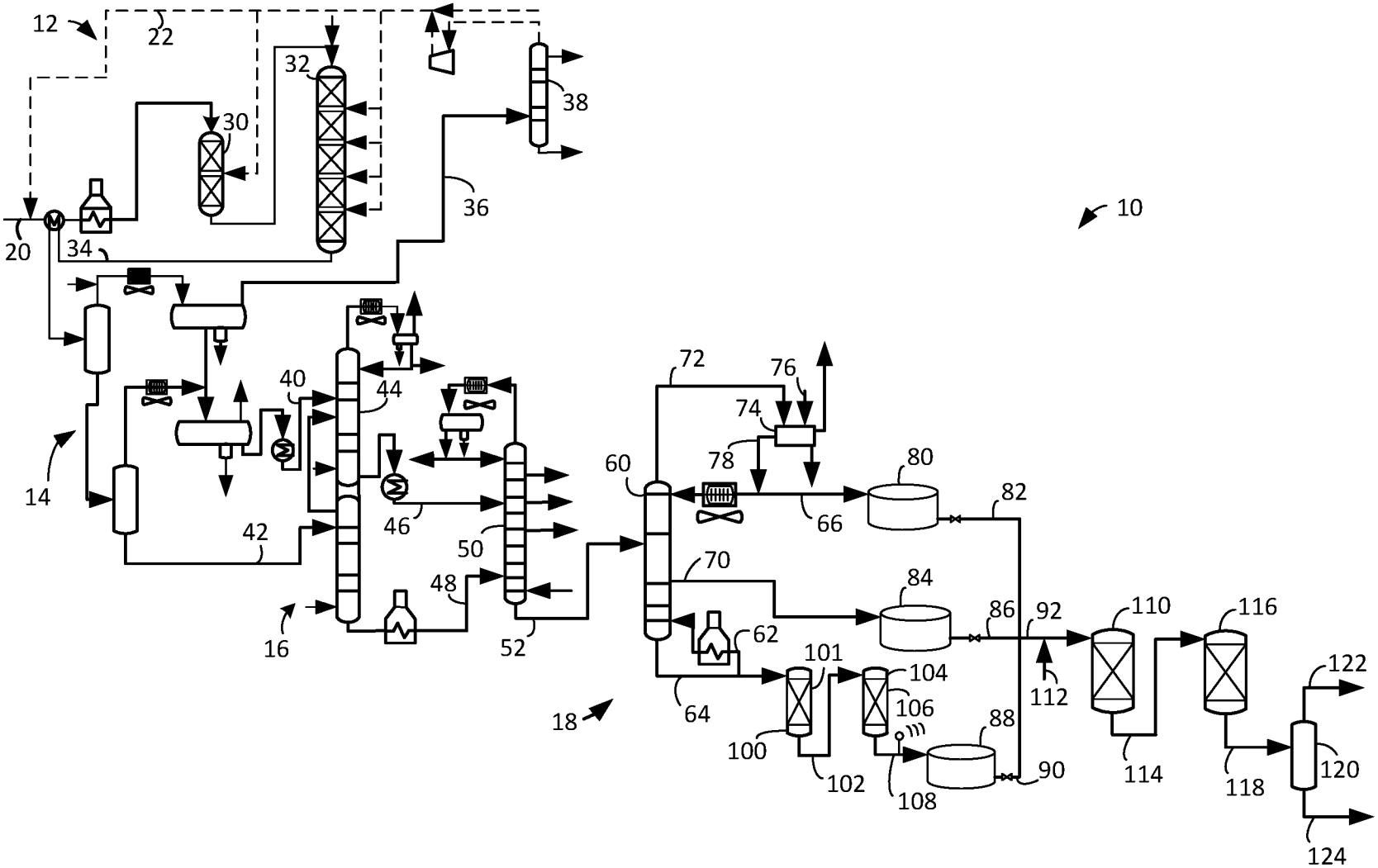
FIG. 1 is a flow diagram illustrating a process for manufacturing lubrication oil.

The term "communication" means that fluid flow is operatively permitted between enumerated components, which may be characterized as "fluid communication". The term "communication" may also mean that data or signals are transmitted between enumerated components which may be characterized as "informational communication".

The term "downstream communication" means that at least a portion of fluid flowing to the subject in downstream communication may operatively flow from the object with which it fluidly communicates.

The term "upstream communication" means that at least a portion of the fluid flowing from the subject in upstream communication may operatively flow to the object with which it fluidly communicates.

The term "direct communication" means that fluid flow from the upstream component enters the downstream component without passing through any other intervening vessel.

The term "indirect communication" means that fluid flow from the upstream component enters the downstream component after passing through an intervening vessel.

The term "downstream communication" means that at least a portion of material flowing to the subject in downstream communication may operatively flow from the object with which it communicates.

The term "upstream communication" means that at least a portion of the material flowing from the subject in upstream communication may operatively flow to the object with which it communicates.

The term "direct communication" means that flow from the upstream component enters the downstream component without passing through a fractionation or conversion unit to undergo a compositional change due to physical fractionation or chemical conversion.

The term "bypass" means that the object is out of downstream communication with a bypassing subject at least to the extent of bypassing.

The term "column" means a distillation column or columns for separating one or more components of different volatilities. Unless otherwise indicated, each column includes a condenser on an overhead of the column to condense and reflux a portion of an overhead stream back to the top of the column and a reboiler at a bottom of the column to vaporize and send a portion of a bottoms stream back to the bottom of the column. Feeds to the columns may be preheated. The top pressure is the pressure of the overhead vapor at the vapor outlet of the column. The bottom temperature is the liquid bottom outlet temperature. Overhead lines and bottoms lines refer to the net lines from the column downstream of any reflux or reboil to the column. Stripper columns omit a reboiler at a bottom of the column and instead provide heating requirements and separation impetus from a fluidized inert media such as steam.

As used herein, the term "True Boiling Point" (TBP) means a test method for determining the boiling point of a material which corresponds to ASTM D2887 for the production of distillate fractions and residuum of standardized quality on which analytical data can be obtained, and the determination of yields of the above fractions by both mass and volume from which a graph of temperature versus mass % distilled is produced.

As used herein, the term "conversion" means conversion of feed to material that boils at or below the diesel boiling range. The diesel cut point of the diesel boiling range is between about 343° and about 399° C. (650° to 750° F.) using the True Boiling Point distillation method.

As used herein, the term "T5" or "T95" means the temperature at which 5 mass percent or 95 mass percent, as the case may be, respectively, of the sample boils using ASTM D-86 or TBP.

As used herein, the term "initial boiling point" (IBP) means the temperature at which the sample begins to boil using ASTM D-7169, ASTM D-86 or TBP, as the case may be.

As used herein, the term "end point" (EP) means the temperature at which the sample has all boiled off using ASTM D-7169, ASTM D-86 or TBP, as the case may be.

As used herein, the term "diesel boiling range" means hydrocarbons boiling in the range of an IBP between about 125° C. (257° F.) and about 175° C. (347° F.) or a T5 between about 150° C. (302° F.) and about 200° C. (392° F.) and the "diesel cut point" comprising a T95 between about 343° C. (650° F.) and about 399° C. (750° F.) using the TBP distillation method.

As used herein, the term "separator" means a vessel which has an inlet and at least an overhead vapor outlet and a bottoms liquid outlet and may also have an aqueous stream outlet from a boot. A flash drum is a type of separator which may be in downstream communication with a separator that may be operated at higher pressure.

As used herein, the term "predominant", "predominantly" or "predominate" means greater than 50%, suitably greater than 75% and preferably greater than 90%.

DETAILED DESCRIPTION

We have found that five and six ring aromatics cause lube oil to fail ASTM D156 Saybolt color tests. We have also found that HPNA's selectively adsorb onto adsorbent displacing five and six ring aromatics which pass through the adsorbent. Hence, with these findings we propose a process to adsorb five and six ring aromatics in a dedicated adsorber.

In FIG. 1, a process and apparatus 10 for producing lube base oil comprises a hydrocracking unit 12, a separation section 14, a fractionation section 16 and a lube base unit 18. A hydrocarbonaceous stream in hydrocarbon line 20 and a hydrogen-rich stream in hydrogen line 22 are combined, heated and fed to the hydrocracking unit 12. The heated, combined stream may first being hydrotreated in a hydrotreating reactor 30 before being passed to a hydrocracking reactor 32.

Illustrative hydrocarbonaceous feed stocks particularly for hydrocracking units include hydrocarbon streams having initial boiling points (IBP) above about 288° C. (550° F.), such as atmospheric gas oils, vacuum gas oil (VGO) having T5 and T95 between about 315° C. (600° F.) and about 650° C. (1200° F.), deasphalted oil, coker distillates, straight run distillates, pyrolysis-derived oils, high boiling synthetic oils, cycle oils, clarified slurry oils, deasphalted oil, shale oil, hydrocracked feeds, catalytic cracker distillates, atmospheric residue having an IBP at or above about 343° C. (650° F.) and vacuum residue having an IBP above about 510° C. (950° F.).

Hydrotreating is a process wherein hydrogen is contacted with hydrocarbon in the presence of suitable catalysts which are primarily active for the removal of heteroatoms, such as sulfur, nitrogen and metals from the hydrocarbon feedstock. In hydrotreating, hydrocarbons with double and triple bonds may be saturated. Aromatics may also be saturated.

Suitable hydrotreating catalysts are any known conventional hydrotreating catalysts and include those which are comprised of at least one Group VIII metal, preferably iron, cobalt and nickel, more preferably cobalt and/or nickel and at least one Group VI metal, preferably molybdenum and tungsten, on a high surface area support material, preferably alumina. Other suitable hydrotreating catalysts include zeolitic catalysts, as well as noble metal catalysts where the noble metal is selected from palladium and platinum. It is within the scope of the present description that more than one type of hydrotreating catalyst be used in the same hydrotreating reactor 30. The Group VIII metal is typically present in an amount ranging from about 2 to about 20 wt %, preferably from about 4 to about 12 wt %. The Group VI metal will typically be present in an amount ranging from about 1 to about 25 wt %, preferably from about 2 to about 25 wt %.

Preferred hydrotreating reaction conditions include a temperature from about 290° C. (550° F.) to about 455° C. (850° F.), suitably 316° C. (600° F.) to about 427° C. (800° F.) and preferably 343° C. (650° F.) to about 399° C. (750° F.), a pressure from about 2.8 MPa (gauge) (400 psig) to about 17.5 MPa (gauge) (2500 psig), a liquid hourly space velocity of the fresh hydrocarbonaceous feedstock from about 0.1 hr-1, suitably 0.5 to about 5 $hr^{-1}$, preferably from about 1.5 to about 4 $hr^{-1}$, and a hydrogen rate of about 84 $Nm^3/m^3$ (500 scf/bbl), to about 1,011 $Nm^3/m^3$ oil (6,000 scf/bbl), preferably about 168 $Nm^3/m^3$ oil (1,000 scf/bbl) to about 1,250 $Nm^3/m^3$ oil (7,500 scf/bbl), with a hydrotreating catalyst or a combination of hydrotreating catalysts.

Hydrocracking is a process in which hydrocarbons crack in the presence of hydrogen to lower molecular weight hydrocarbons. The hydrocracking reactor 32 may be a fixed bed reactor that comprises one or more vessels, single or multiple catalyst beds in each vessel, and various combinations of hydrotreating catalyst and/or hydrocracking catalyst in one or more vessels. The hydrocracking reactor 32 may also be operated in a conventional continuous gas phase, a moving bed or a fluidized bed hydroprocessing reactor. The hydrocarbon feed stream is hydrocracked over a hydrocracking catalyst in the hydrocracking reactor 32 in the presence of a hydrogen stream to provide a hydrocracked effluent stream.

The hydrocracking catalyst may utilize amorphous silica-alumina bases or low-level zeolite bases combined with one or more Group VIII or Group VIB metal hydrogenating components if mild hydrocracking is desired to produce a balance of middle distillate and gasoline. In another aspect, when middle distillate is significantly preferred in the converted product over gasoline production, partial or full hydrocracking may be performed in the hydrocracking reactor 32 with a catalyst which comprises, in general, any crystalline zeolite cracking base upon which is deposited a Group VIII metal hydrogenating component. Additional hydrogenating components may be selected from Group VIB for incorporation with the zeolite base. The zeolite cracking bases are sometimes referred to in the art as molecular sieves and are usually composed of silica, alumina and one or more exchangeable cations such as sodium, magnesium, calcium, rare earth metals, etc. They are further characterized by crystal pores of relatively uniform diameter between about 4 and about 14 Angstroms. It is preferred to employ zeolites having a relatively high silica/alumina mole ratio between about 3 and about 12. Suitable zeolites found in nature include, for example, mordenite, stilbite, heulandite, ferrierite, dachiardite, chabazite, erionite and faujasite. Suitable synthetic zeolites include, for example, the B, X, Y and L crystal types, e.g., synthetic faujasite and mordenite. The preferred zeolites are those having crystal pore diameters between about 8 and 12 Angstroms, wherein the silica/alumina mole ratio is about 4 to 6. One example of a zeolite falling in the preferred group is synthetic Y molecular sieve.

The active metals employed in the preferred hydrocracking catalysts of the present invention as hydrogenation components are those of Group VIII, i.e., iron, cobalt, nickel, ruthenium, rhodium, palladium, osmium, iridium and platinum. In addition to these metals, other promoters may also be employed in conjunction therewith, including the metals of Group VIB, e.g., molybdenum and tungsten. The amount of hydrogenating metal in the catalyst can vary within wide ranges. Broadly speaking, any amount between about 0.05 wt % and about 30 wt % may be used. In the case of the noble metals, it is normally preferred to use about 0.05 to about 2 wt % noble metal.

The method for incorporating the hydrogenation metal is to contact the base material with an aqueous solution of a suitable compound of the desired metal wherein the metal is present in a cationic form. Following addition of the selected hydrogenation metal or metals, the resulting catalyst powder is then filtered, dried, pelleted with added lubricants, binders or the like if desired, and calcined in air at temperatures of, e.g., about 371° C. (700° F.) to about 648° C. (200° F.) in order to activate the catalyst and decompose ammonium ions. Alternatively, the base component may be pelleted, followed by the addition of the hydrogenation component and activation by calcining.

The foregoing catalysts may be employed in undiluted form, or the powdered catalyst may be mixed and copelleted with other relatively less active catalysts, diluents or binders such as alumina, silica gel, silica-alumina cogels, activated clays and the like in proportions ranging between about 5 and about 90 wt %. These diluents may be employed as such or they may contain a minor proportion of an added hydrogenating metal such as a Group VIB and/or Group VIII metal. Additional metal promoted hydrocracking catalysts may also be utilized in the process of the present invention which comprises, for example, aluminophosphate molecular sieves, crystalline chromosilicates and other crystalline silicates. Crystalline chromosilicates are more fully described in U.S. Pat. No. 4,363,178.

By one approach, the hydrocracking conditions may include a temperature from about 290° C. (550° F.) to about 468° C. (875° F.), preferably 343° C. (650° F.) to about 445° C. (833° F.), a pressure from about 4.8 MPa (gauge) (700 psig) to about 20.7 MPa (gauge) (3000 psig), a liquid hourly space velocity (LHSV) from about 0.4 to less than about 2.5 $hr^{-1}$ and a hydrogen rate of about 421 $Nm^3/m^3$ (2,500 scf/bbl) to about 2,527 $Nm^3/m^3$ oil (15,000 scf/bbl). If mild hydrocracking is desired, conditions may include a temperature from about 35° C. (600° F.) to about 441° C. (825° F.), a pressure from about 5.5 MPa (gauge) (800 psig) to about 3.8 MPa (gauge) (2000 psig) or more typically about 6.9 MPa (gauge) (1000 psig) to about 11.0 MPa (gauge) (1600 psig), a liquid hourly space velocity (LHSV) from about 0.5 to about 2 $hr^{-1}$ and preferably about 0.7 to about 1.5 $hr^{-1}$ and a hydrogen rate of about 421 $Nm^3/m^3$ oil (2,500 scf/bbl) to about 1,685 $Nm^3/m^3$ oil (10,000 scf/bbl).

The hydrocracked effluent stream may exit the hydrocracking reactor 32 in hydrocracked effluent line 34 and be separated in the separation section 14 in downstream communication with the hydrocracking reactor 32. The separation section 14 comprises one or more separators in downstream communication with the hydrocracking reactor 32. The separation section cools and depressurizes while separating the hydrocracked effluent stream to produce a hydrogen recycle stream in recycle line 36 that may be scrubbed of acid gases in a scrubber 38 and recycled to the hydrocracking unit 12. Two hydrocracked liquid streams in separator bottoms lines 40, 42 are stripped in a stripper column 44 of light gases and fed to a product fractionation column 50. The stripper column 44 may comprise two strippers.

The stripping column 44 may be operated with an overhead pressure of about 0.7 MPa (gauge) (100 psig), preferably no less than about 0.34 MPa (gauge) (50 psig), to no more than about 2.0 MPa (gauge) (290 psig). The stripping column 44 may be operated with a bottoms temperature between about 160° C. (320° F.) and about 360° C. (680° F.) and an overhead pressure of about 0.7 MPa (gauge) (100 psig), preferably no less than about 0.34 MPa (gauge) (50 psig), to no more than about 2.0 MPa (gauge) (290 psig).

The product fractionation column 50 fractionates one or more stripped hydrocracked streams 46 and 48 to produce several product streams including naphtha, kerosene and diesel streams. An unconverted oil (UCO) stream is taken from a fractionator bottoms line 52 of the product fractionation column 50 for lube oil processing. The UCO stream boiling above the diesel cut point may be taken in the fractionator bottoms line 52 from a bottom of the product fractionation column 50. A portion or all of the UCO stream in the fractionator bottoms line 52 may be fed to the lube oil unit 18.

Product streams from the product fractionation column may also be stripped to remove light materials to meet product purity requirements. The product fractionation column 50 may be operated with a bottoms temperature between about 260° C. (500° F.) and about 385° C. (725° F.), preferably at no more than about 380° C. (715° F.), and at an overhead pressure between about 7 kPa (gauge) (1 psig) and about 69 kPa (gauge) (10 psig).

The lube oil unit 18 may optionally include a feed preparation column 60 for fractionating the UCO stream into different cuts identifiable by their viscosity. The lube oil unit 18 may omit a feed preparation column 60. The feed preparation column 60 may be in downstream communication with the product fractionation column 50. A reboil stream may be taken from the lube bottoms line 64 or from a bottom of the feed preparation column 60 in a reboil line 62, heated in a reboil heater and returned to the column. The reboil heater—may provide heat to the feed preparation column to promote separation of lighter components from the heavier components.

The feed preparation column 60 produces at least two cuts, a light UCO stream taken above a lube bottoms line 64 and a heavy UCO stream in the lube bottoms line 64. The heavy UCO stream may have a viscosity of about 5 to about 12 cst, typically has a viscosity of about 6 to about 9 cst, and will have a predominance of the HPNAs. In an aspect, the heavy UCO stream may also have a predominance of the five and six ring PNAs when the light UCO stream taken above the lube bottoms line 64 has an end point of no more than about 450 to about 490° C.

The light UCO stream may be taken in an overhead stream in an overhead line 66 or in a side cut stream in a side line 70. The light UCO stream may have a viscosity of about 1 to about 5 cst and typically about 2 to about 4 cst. In another aspect, the light UCO stream may have the predominance of the five and six ring PNAs. In such a case the light UCO stream will have an end point of at least about 480 to about 520° C. or less.

The feed preparation column 60 is operated under vacuum at below atmospheric pressure in the overhead. An overhead stream in an overhead line 72 may feed a vacuum generating device 74 which is in downstream communication with the overhead line. The vacuum generating device 74 may include an eductor or a vacuum pump in communication with an inert gas stream 76 such as steam which pulls a vacuum on the overhead stream in the overhead line 72. A condensed hydrocarbon stream in line 78 from the vacuum generating device 74 may be returned to the feed preparation column 60. A condensed aqueous stream may also be removed from the vacuum generating device. A vaporous stream which may include hydrocarbon vapor may be removed from the vapor generating device.

Heat may be removed from the feed preparation column 60 by cooling a portion of the condensed hydrocarbon stream in line 78 and sending the cooled stream back to the column. The feed preparation column 60 may be operated with a bottoms temperature between about 260° C. (500° F.), and about 370° C. (700° F.), preferably about 300° C. (570° F.), and at an overhead pressure between about 27 kPa (absolute) (3.9 psia) and about 67 kPa (absolute) (9.7 psia), and preferably about 40 kPa (absolute) (5.8 psia) to about 53 kPa (absolute) (7.7 psia).

The heavy UCO stream in lube bottoms line 64 will typically contain the predominance of the HPNAs. If the concentration of HPNAs in the heavy UCO stream exceeds 100 wppm, the lube bottoms stream will not be acceptable as lube product due to their potential to cause lube oil color and catalyst deactivation. The heavy UCO stream is conducted via lube bottoms line 64 to an adsorbent bed 101 in an adsorber 100 to adsorb HPNAs down to below a concentration of no more than 100 wppm. Activated carbon is an adsorbent in the bed 101 for adsorbing HPNAs which may be derived from various sources including petroleum coke, coal, wood, and shells, such as coconut shells, using carbonization and/or activation process steps. Activation may be accomplished, e.g. by thermal treatment under an atmosphere of $CO_2$, $H_2O$, and mixtures thereof, by chemical treating steps, and combinations thereof. Suitable activated carbon is commercially available and may be obtained for example from Calgon Activated Corp. of Compton, Calif., USA.

The heavy UCO stream to be treated is contacted with and adsorbent such as activated carbon at contacting conditions to remove one or more HPNA compounds and produce a depleted HPNA UCO stream in an HPNA depleted line 102. The HPNA compounds may be removed from the heavy UCO stream by various mechanisms such as adsorption, reaction, and reactive adsorption with the adsorbent. The depleted HPNA UCO stream has a lower HPNA concentration relative to the HPNA concentration of the heavy UCO stream. The contacting conditions include a temperature of at least about 50° C., for example from about 100 to about 300° C. and a pressure of about 1 MPa (abs) (150 psia) to about 1.7 MPa (abs) (250 psia).

The adsorber 100 may be configured in a lead/lag configuration including a first bed a second bed. The first and second guard bed may be configured as a swing bed arrangement in which one of the first and second beds is in a contacting mode and the other of the first and second beds is in a regenerative or offline mode. Conversely, when the first bed adsorbs its full capacity of HPNAs, the first bed may be switched to the regenerative or offline mode and the second bed may be switched to the contacting mode. The HPNA depleted UCO stream continues downstream via a depleted line 102.

In the embodiment of FIG. 1, the heavy UCO stream comprises the predominance of the five and six ring PNAs from the fractionator bottoms line 52 and may be taken as a heavy UCO feedstock. We have found that when an adsorbent bed begins to reach its capacity of HPNA adsorption, the HPNAs begin to displace five and six ring PNAs. We have also found five and six ring PNAs cause a lube product to exhibit color and therefore be unacceptable to lube customers. Hence, in this embodiment, we propose to install a second adsorber 104 downstream of the first adsorber 100. The second adsorber 104 is dedicated to adsorbing five and six ring aromatics from the heavy UCO feedstock taken from the heavy UCO stream. Hence, a predominance of the HPNA's will already have been adsorbed out of the heavy UCO feedstock before encountering the second adsorber, so HPNAs will not displace adsorbed PNAs. The second adsorber 104 may contain an adsorbent bed 106 that can adsorb five and six ring PNAs. A suitable adsorbent for adsorbing five and six ring PNAs is ColorSorb 5000 available from Jacobi Carbons in Sweden which also comprises activated carbon. The adsorbent in the second adsorbent bed 106 may have a different composition than the adsorbent in the first adsorbent bed 101. A treated UCO feedstock with an acceptable concentration of HPNAs and no more than 100 wppm of five and six ring PNAs is transported in a treated UCO line 108. The contacting conditions in the second adsorber 104 include a temperature of at least about 50° C., for example from about 100 to about 300° C. and a pressure of about 1 MPa (abs) (150 psia) to about 1.7 MPa (abs) (250 psia). The adsorber 100 may also be configured in a lead/lag configuration including a first bed and a second bed. Adsorbing five and six ring PNA's down to 50 wppm may be suitable and down to 10 wppm may be preferable in the treated UCO line 108.

The overhead stream in line 66 may feed an overhead tank 80 for storage. An overhead storage line 82 with a control valve thereon may regulate flow of stored overhead stream from the overhead tank to downstream processing in a lube product line 92. The side stream in the side line 70 may feed a side tank 84 for storage. A side storage line 86 with a control valve thereon may regulate flow of the stored side stream from the side tank to downstream processing in the lube product line 92. The heavy treated UCO feedstock in the heavy treated UCO line 108 may feed a bottoms tank 88 for storage. A bottoms storage line 90 with a control valve thereon may regulate flow of the stored bottoms stream from the bottoms tank 88 to downstream processing in the lube product line 92.

With the PNA and HPNA compounds removed from or reduced to acceptable concentration in the heavy UCO stream, the heavy treated UCO feedstock in the bottom storage line 90 or some or all of the overhead stream in the overhead storage line 82 or the side stream in the side storage line 86 may be mixed or not and passed in the lube product line 92 to catalytic dewaxing unit 110. Make-up hydrogen-containing treat gas can be introduced via line 112 to the dewaxing reactor 110. Catalytic dewaxing can be performed by contacting the feedstock with a dewaxing catalyst and hydrogen under effective catalytic dewaxing conditions. Effective dewaxing conditions can include a temperature of at least 500° F. (260° C.), or at least 550° F. (288° C.), or at least 600° F. (316° C.), or at least 650° F. (343° C.). Alternatively, the temperature can be 750° F. (399° C.) or less, or 700° F. (371° C.) or less, or 650° F. (343° C.) or less. The pressure can be at least 200 psig (1.4 MPa), or at least 400 psig (2.8 MPa), or at least 750 psig (5.2 MPa), or at least 1000 psig (6.9 MPa). Alternatively, the pressure can be 2500 psig (17.2 MPa) or less, or 1200 psig (8.2 MPa) or less, or 1000 psig (6.9 MPa) or less, or 800 psig (5.5 MPa) or less. The liquid hourly space velocity (LHSV) over the dewaxing catalyst can be at least 0.1 $hr^{-1}$, or at least 0.2 $hr^{-1}$, or at least 0.5 $hr^{-1}$, or at least 1.0 $hr^{-1}$, or at least 1.5 $hr^{-1}$. Alternatively, the LHSV can be 10.0 $hr^{-1}$ or less, or 5.0 $hr^{-1}$ or less, or 3.0 $hr^{-1}$ or less, or 2.0 $hr^{-1}$ or less.

Catalytic dewaxing involves the isomerization of long chain, paraffinic, waxy molecules in feeds. Catalytic dewaxing can be accomplished by selective cracking or by hydroisomerizing these linear molecules. Hydrodewaxing catalysts can be selected from molecular sieves such as crystalline aluminosilicates, zeolites or silico-aluminophosphates (SAPOs). In an embodiment, the molecular sieve can be a 1-D or 3-D molecular sieve. In another embodiment, the molecular sieve can be a 10-member ring 1-D molecular sieve. Examples of molecular sieves which have shown dewaxing activity in the literature can include ZSM-48, ZSM-22, ZSM-23, ZSM-35, Beta, USY, ZSM-5, and combinations thereof. In an embodiment, the molecular sieve can be ZSM-22, ZSM-23, ZSM-35, ZSM-48, or a combination thereof. In still another embodiment, the molecular sieve can be ZSM-48, ZSM-23, ZSM-5, or a combination thereof. In yet another embodiment, the molecular sieve can be ZSM-48, ZSM-23, or a combination thereof. Optionally, the dewaxing catalyst can include a binder for the molecular sieve, such as alumina, titania, silica, silica-alumina, zirconia, or a combination thereof.

One feature of molecular sieves that can impact their catalytic activity is the ratio of silica to alumina in the molecular sieve. In an embodiment, the molecular sieve can have a silica to alumina ratio of 200 to 1 or less, or 120 to 1 or less, or 100 to 1 or less, or 90 to 1 or less, or 75 to 1 or less. In an embodiment, the molecular sieve can have a silica to alumina ratio of at least 30 to 1, or at least 50 to 1, or at least 65 to 1.

The dewaxing catalyst can also include a metal hydrogenation component, such as a Group VIII metal. Suitable Group VIII metals can include Pt, Pd, Ni, or a combination thereof. The dewaxing catalyst can include at least 0.1 wt % of a Group VIII metal, or at least 0.3 wt %, or at least 0.5 wt %, or at least 1.0 wt %, or at least 2.5 wt %, or at least 5.0 wt %. Alternatively, the dewaxing catalyst can include 10.0 wt % or less of a Group VIII metal, or 5.0 wt % or less, or 2.5 wt % or less, or 1.5 wt % or less, or 1.0 wt % or less. In some embodiments, the dewaxing catalyst can also include at least one Group VIB metal, such as W or Mo. Such Group VIB metals are typically used in conjunction with at least one Group VIII metal, such as Ni or Co. An example of such an embodiment is a dewaxing catalyst that includes Ni and W, Mo, or a combination of W and Mo. In such an embodiment, the dewaxing catalyst can include at least 0.5 wt % of a Group VIB metal, or at least 1.0 wt %, or at least 2.5 wt %, or at least 5.0 wt %. Alternatively, the dewaxing catalyst can include 20.0 wt % or less of a Group VIB metal, or 15.0 wt % or less, or 10.0 wt % or less, or 5.0 wt % or less, or 1.0 wt % or less. In an embodiment, the dewaxing catalyst can include Pt, Pd, or a combination thereof. In another embodiment, the dewaxing catalyst can include Co and Mo, Ni and W, Ni and Mo, or Ni, W, and Mo.

With continued reference to FIG. 1, the effluent from catalytic dewaxing unit is sent to hydrofinishing unit 116 via line 114. The hydrofinishing step following dewaxing offers further opportunity to improve product quality without significantly affecting its pour point. Hydrofinishing is a mild, relatively cool hydrotreating process, that employs a catalyst, hydrogen and mild reaction conditions to remove trace amounts of heteroatom compounds, aromatics and olefins, to improve primarily oxidation stability and color. Hydrofinishing reaction conditions include temperatures from 300° F. to 675° F. (149° C. to 357° C.), preferably from 300° F. to 600° F. (149° C. to 315° C.), a total pressure of from 400 to 3000 psig (2859 to 20786 kPa), a liquid hourly space velocity ranging from 0.1 to 5 $hr^{-1}$, preferably 0.5 to 3 $hr^{-1}$. The hydrotreating catalyst will comprise a support component and one or more catalytic metal components. The one or more metals are selected from Group VIB (Mo, W, Cr) and Group VIII (Ni, Co and the noble metals Pt and Pd). The metal or metals may be present from as little as 0.1 wt % for noble metals, to as high as 30 wt % of the catalyst composition for non-noble metals. Preferred support materials are low in acid and include, for example, amorphous or crystalline metal oxides such as alumina, silica, silica alumina and ultra large pore crystalline materials known as mesoporous crystalline materials, of which MCM-41 is a preferred support component. Unsupported base metal (non-noble metal) catalysts are also applicable as hydrofinishing catalysts.

The effluent stream from hydrofinishing unit 116 is passed via line 118 to a separation unit 120, wherein a gaseous effluent stream 122 is separated from the resulting liquid phase lube oil base stock. The gaseous effluent stream 122, a portion of which will be unreacted hydrogen-containing treat gas can be recycled to the dewaxing unit 110, for example. The resulting lube oil base stock, which will meet Group II or Group III base oil requirements, is collected via line 124, and sent downstream for collection or further processing, if desired.

Accordingly, embodiments of the present disclosure provide methods and systems for manufacturing lubrication oils. The embodiments described herein employ the use of adsorbent beds to remove or reduce the presence of PNAs. As used herein, activated carbon is suitable for absorbing multi-ring species such as PNAs. The treated UCO feedstock from the adsorbent bed is low in five and six ring PNAs and would allow the product to meet desired specifications upon processing in downstream lubrication oil manufacturing units, without premature deactivation of downstream catalytic processes.

In an embodiment in which the feed preparation column 60 is omitted, the adsorbers 100 and 104 would be on line 52 leading to line 92, preferably in the same order as on the lube bottoms line 64 in FIG. 1.

Figure 2:
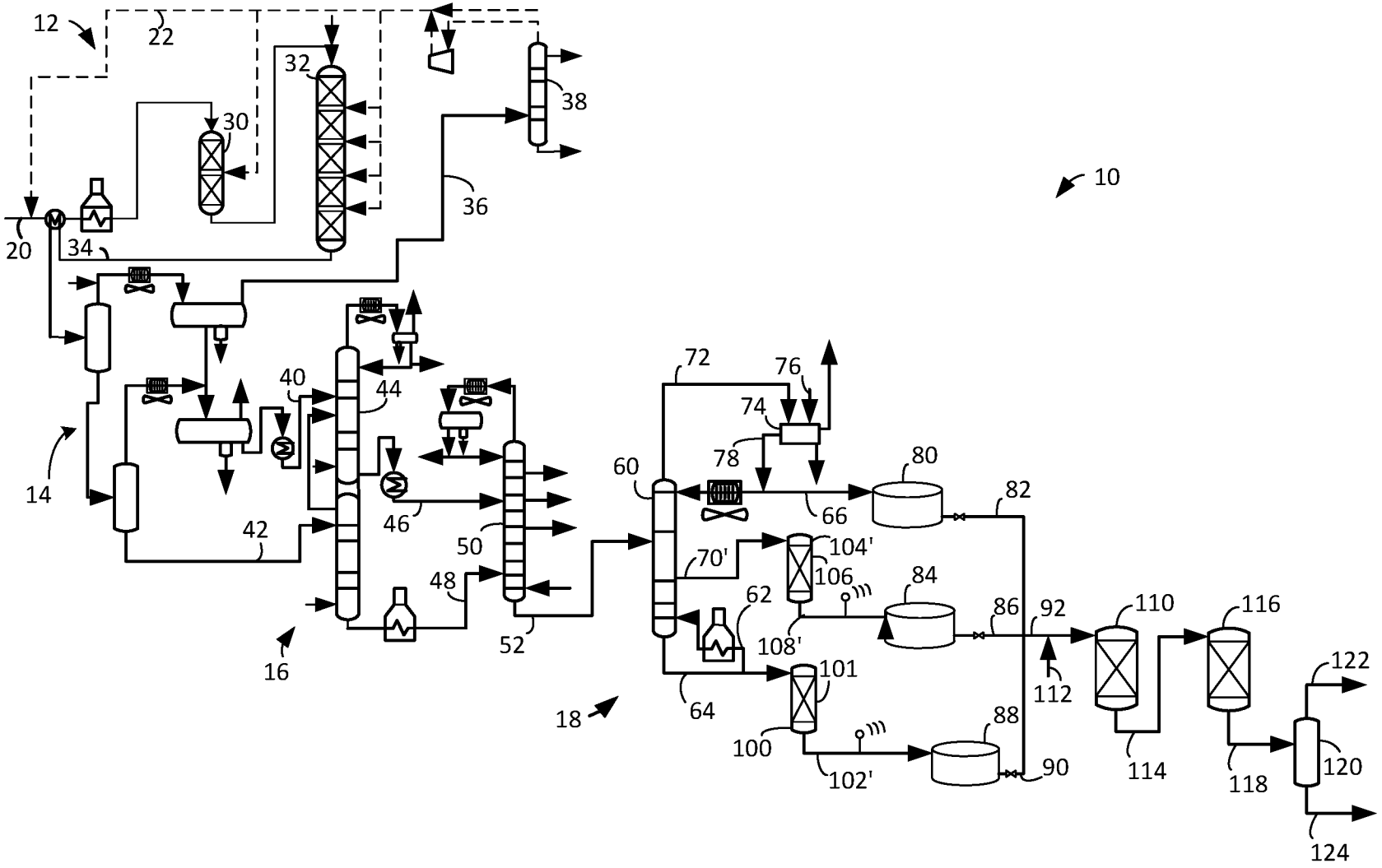
FIG. 2 is an alternative flow diagram illustrating a process for manufacturing lubrication oil.

FIG. 2 shows an embodiment of FIG. 1 in which the light UCO stream comprises the predominance of the five and six ring PNAs and is taken as the UCO feedstock. Elements in FIG. 2 with the same configuration as in FIG. 1 will have the same reference numeral as in FIG. 1. Elements in FIG. 2 which have a different configuration than the corresponding element in FIG. 1 will have the same reference numeral but designated with a prime symbol (').  The configuration and operation of the embodiment of FIG. 2 is essentially the same as in FIG. 1 with the following exceptions.

The heavy UCO stream in the lube bottoms line 64 to be treated is contacted with activated carbon at contacting conditions in a first adsorber 100 to remove one or more HPNA compounds and produce a heavy HPNA depleted UCO stream in a heavy depleted line 102'. The heavy HPNA depleted UCO stream has a lower HPNA concentration relative to the HPNA concentration of the heavy UCO stream and preferably less than 100 wppm HPNAs. The heavy depleted line 102' transports the heavy HPNA depleted UCO stream to the bottoms tank 88. The first adsorber 100 may be configured in a lead/lag configuration including a first bed and a second bed.

In FIG. 2, the light UCO stream which has the predominance of the five and six ring PNAs from the fractionator bottoms line 52 is taken in a side line 70' having an end point of at least about 480 to about 520° C. The light UCO stream in the side line 70' is fed to the second adsorber 104' parallel to the first adsorber 100. The second adsorber 104' is dedicated to adsorbing five and six ring aromatics from the UCO feedstock, that is in the light UCO stream. Hence, a predominance of the HPNA's will be in the heavy UCO stream in the lube bottoms line 64 and will be adsorbed out of the heavy UCO feed stream, so HPNAs will not displace adsorbed PNAs in the second adsorber 104'. The second adsorber 104' may contain an adsorbent bed 106 that can adsorb five and six ring PNAs as explained in regard to FIG. 1. A treated UCO feedstock with an acceptable concentration of HPNAs and no more than 100 wppm of five and six ring PNAs is transported in a treated UCO line 108'. The adsorber 104' may be configured in a lead/lag configuration including a first bed and a second bed. The treated UCO feedstock in the treated UCO line 108' may feed a side tank 84 for storage.

The rest of FIG. 2 operates as explained for FIG. 1.

The light UCO stream could be taken in the overhead line 66 of the feed preparation column 60 which may or may not omit the side stream inside line 70. In such an embodiment, the second adsorber 104 may be located on the overhead line 66.

Any of the above lines, units, separators, columns, surrounding environments, zones or similar may be equipped with one or more monitoring components including sensors, measurement devices, data capture devices or data transmission devices. Signals, process or status measurements, and data from monitoring components may be used to monitor conditions in, around, and on process equipment. Signals, measurements, and/or data generated or recorded by monitoring components may be collected, processed, and/or transmitted through one or more networks or connections that may be private or public, general or specific, direct or indirect, wired or wireless, encrypted or not encrypted, and/or combination(s) thereof; the specification is not intended to be limiting in this respect.

Signals, measurements, and/or data generated or recorded by monitoring components may be transmitted to one or more computing devices or systems. Computing devices or systems may include at least one processor and memory storing computer-readable instructions that, when executed by the at least one processor, cause the one or more computing devices to perform a process that may include one or more steps. For example, the one or more computing devices may be configured to receive, from one or more monitoring components, data related to at least one piece of equipment associated with the process. The one or more computing devices or systems may be configured to analyze the data. Based on analyzing the data, the one or more computing devices or systems may be configured to determine one or more recommended adjustments to one or more parameters of one or more processes described herein. The one or more computing devices or systems may be configured to transmit encrypted or unencrypted data that includes the one or more recommended adjustments to the one or more parameters of the one or more processes described herein.

EXAMPLES

Example 1

A refiner was having trouble with color bodies in a lube oil base stock. The refiner had been using a carbon bed adsorbent to remove HPNA's from the lube oil base stock upstream of a hydrodewaxing unit and a hydrofinishing unit and testing confirmed that less than detectable wppm levels of HPNA's were present in the lube oil base stock. However, color testing did indicate that the lube oil base stock did contain color bodies. We tested and identified that 5-ring and 6-ring aromatics in the lube oil base stock samples were responsible for the color bodies.

Lube oil base stock samples having a Saybolt color value of 28 spiked with pure 1-4-ring aromatic compounds did not reduce the Saybolt color value substantially. Samples spiked with 25 and 192 wppm of 1-aromatic ring tetralin did not change the Saybolt color value from 28. Samples spiked with 25 wppm of 2-ring naphthalene and 4-ring pyrene also exhibited no change in Saybolt color value. Only the sample spiked with 25 wppm of 3-ring 9-methylanthracene reduced Saybolt color down to 27 from 28, which was, however, still within the acceptable range. Saybolt color value of 23 is minimally acceptable. However, 25 wppm of 5-ring, perylene resulted in a visually yellow lube oil base stock sample, and 25 wppm of 6-ring benzoperylene resulted in a visually pale yellow sample with a Saybolt color value of 21. This finding was to our surprise because it challenges the conventional view that 5-ring and 6-ring aromatics did not cause color in lube oil base stock.

Example 2

Figure 3:
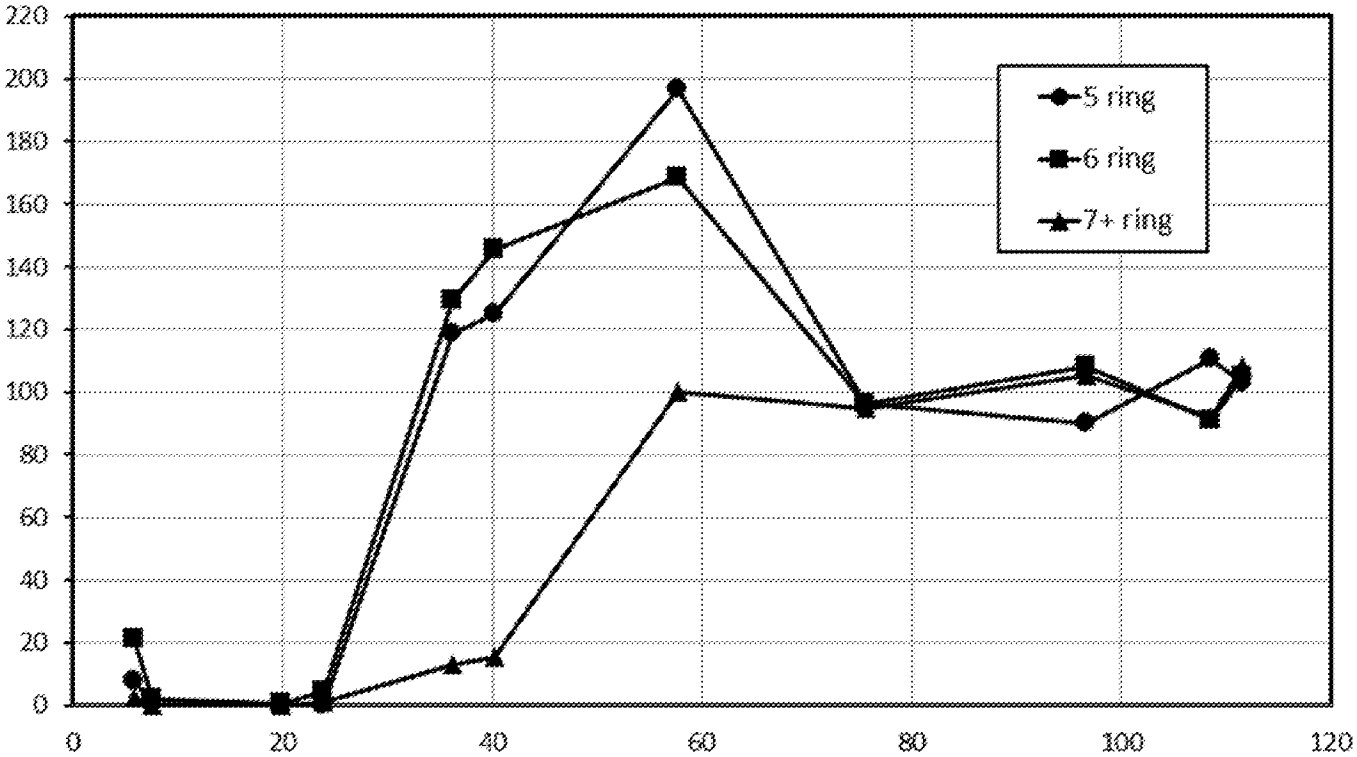
FIG. 3 is a plot of mass percentage of breakthrough concentration as a function of cumulative mass feed per mass of adsorbent

We ran an experiment to determine whether a single adsorbent was effective to remove both PNAs and HPNAs from a UCO stream. We contacted a Calgon activated carbon 12×40 mesh at 260° C., 1.2 MPa (200 psig) and 0.6 hr-1 LHSV with no co-feed. Results are shown in FIG. 3 in which the vertical axis is the mass percentage of breakthrough concentration and the horizontal axis is the cumulative mass feed per mass of adsorbent. Initially, the five ring PNAs, circles, and the six ring PNAs, rectangles, were removed effectively. However, as more seven ring HPNAs, triangles, started to break through the adsorbent bed, the five and six ring PNA's started to break through also.

Specific Embodiments

While the following is described in conjunction with specific embodiments, it will be understood that this description is intended to illustrate and not limit the scope of the preceding description and the appended claims.

A first embodiment of the invention is a process for manufacturing a lubrication oil, the process comprising contacting a UCO feedstock with a PNA adsorbent to remove PNA compounds with five and six aromatic rings, thereby providing a treated UCO feedstock with no more than 100 wppm of five and six aromatic rings. An embodiment of the invention is one, any or all of prior embodiments in this paragraph up through the first embodiment in this paragraph, wherein the PNA adsorbent is an activated carbon. An embodiment of the invention is one, any or all of prior embodiments in this paragraph up through the first embodiment in this paragraph, further comprising contacting the treated UCO feedstock with a dewaxing catalyst and a hydrofinishing catalyst. An embodiment of the invention is one, any or all of prior embodiments in this paragraph up through the first embodiment in this paragraph, further comprising contacting the UCO feedstock with a HPNA adsorbent to remove HPNA compounds having at least seven aromatic rings. An embodiment of the invention is one, any or all of prior embodiments in this paragraph up through the first embodiment in this paragraph, wherein the HPNA adsorbent is contacted with the UCO feedstock before the PNA adsorbent is contacted with the UCO feedstock. An embodiment of the invention is one, any or all of prior embodiments in this paragraph up through the first embodiment in this paragraph, wherein the HPNA adsorbent has a different composition than the PNA adsorbent. An embodiment of the invention is one, any or all of prior embodiments in this paragraph up through the first embodiment in this paragraph, wherein the HPNA adsorbent and the PNA adsorbent are activated carbons. An embodiment of the invention is one, any or all of prior embodiments in this paragraph up through the first embodiment in this paragraph, further comprising contacting a hydrocarbon feed stream with hydrocracking catalyst to provide a hydrocracked stream and fractionating the hydrocracked stream to provide a UCO stream and taking the UCO feedstock from the UCO stream. An embodiment of the invention is one, any or all of prior embodiments in this paragraph up through the first embodiment in this paragraph, further comprising fractionating the UCO stream to provide a heavy UCO stream comprising the UCO feedstock. An embodiment of the invention is one, any or all of prior embodiments in this paragraph up through the first embodiment in this paragraph, further comprising fractionating the UCO stream to provide a light UCO stream comprising the UCO feedstock and a heavy UCO stream and contacting the heavy UCO stream with a HPNA adsorbent to remove HPNA compounds having at least seven aromatic rings. An embodiment of the invention is one, any or all of prior embodiments in this paragraph up through the first embodiment in this paragraph, further comprising at least one of a sensor in fluid communication with the PNA adsorbent for sensing at least one parameter; and a transmitter in communication with the device for transmitting a signal or data from the sensor.

A second embodiment of the invention is a process for manufacturing a lubrication oil, the process comprising contacting a UCO feedstock with a HPNA adsorbent to remove HPNA compounds having at least seven aromatic rings; contacting the UCO feedstock with a PNA adsorbent to remove PNA compounds with five and six aromatic rings; and providing a treated UCO feedstock with no more than 100 wppm of five and six aromatic rings. An embodiment of the invention is one, any or all of prior embodiments in this paragraph up through the second embodiment in this paragraph, wherein the PNA adsorbent and the HPNA adsorbent are activated carbons. An embodiment of the invention is one, any or all of prior embodiments in this paragraph up through the second embodiment in this paragraph, wherein the HPNA adsorbent is contacted with the UCO feedstock before the PNA adsorbent is contacted with the UCO feedstock. An embodiment of the invention is one, any or all of prior embodiments in this paragraph up through the second embodiment in this paragraph, further comprising contacting a hydrocarbon feed stream with hydrocracking catalyst to provide a hydrocracked stream and fractionating the hydrocracked stream to provide a UCO stream from which the UCO feedstock is taken. An embodiment of the invention is one, any or all of prior embodiments in this paragraph up through the second embodiment in this paragraph, further comprising fractionating the UCO stream to provide a heavy UCO stream comprising the UCO feedstock and a light UCO stream and mixing the treated UCO feedstock with the light UCO stream feedstock to provide a lube feed stream.

A third embodiment of the invention is a process for manufacturing a lubrication oil, the process comprising contacting a hydrocarbon feed stream with hydrocracking catalyst to provide a hydrocracked stream and fractionating the hydrocracked stream to provide a UCO stream; fractionating the UCO stream to provide a heavy UCO stream and a light UCO stream; taking one of the heavy UCO stream and the light UCO stream as a UCO feedstock; contacting the UCO feedstock with a PNA adsorbent to remove PNA compounds with five and six aromatic rings; and providing a treated UCO feedstock with no more than 100 wppm of five and six aromatic rings. An embodiment of the invention is one, any or all of prior embodiments in this paragraph up through the third embodiment in this paragraph, further comprising taking the heavy UCO stream as the UCO feedstock and contacting the UCO feedstock with a HPNA adsorbent to remove HPNA compounds having at least seven aromatic rings. An embodiment of the invention is one, any or all of prior embodiments in this paragraph up through the third embodiment in this paragraph, wherein the UCO feedstock is contacted with the HPNA adsorbent before the UCO feedstock is contacted with the PNA adsorbent. An embodiment of the invention is one, any or all of prior embodiments in this paragraph up through the third embodiment in this paragraph, further comprising taking the light UCO stream as the UCO feedstock and contacting the heavy UCO stream with a HPNA adsorbent to remove HPNA compounds having at least seven aromatic rings.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

The invention claimed is:

1. A process for manufacturing a lubrication oil, the process comprising:

fractionating a UCO stream to provide a light UCO stream comprising a UCO feedstock and a heavy UCO stream and contacting said heavy UCO stream with a HPNA adsorbent to remove HPNA compounds having at least seven aromatic rings; and contacting said UCO feedstock with a PNA adsorbent to remove PNA compounds with five and six aromantic rings, thereby providing a treated UCO feedstock with no more than 100 wppm of five and six aromatic rings.

2. The process of claim 1, wherein the PNA adsorbent is an activated carbon.

3. The process of claim 2, further comprising contacting the treated UCO feedstock with a dewaxing catalyst and a hydrofinishing catalyst.

4. The process of claim 1, further comprising contacting said UCO feedstock with a HPNA adsorbent to remove HPNA compounds having at least seven aromatic rings.

5. The process of claim 4, wherein said HPNA adsorbent is contacted with said UCO feedstock before said PNA adsorbent is contacted with said UCO feedstock.

6. The process of claim 4, wherein said HPNA adsorbent has a different composition than said PNA adsorbent.

7. The process of claim 4, wherein said HPNA adsorbent and said PNA adsorbent are activated carbons.

8. The process of claim 1, further comprising contacting a hydrocarbon feed stream with hydrocracking catalyst to provide a hydrocracked stream and fractionating the hydrocracked stream to provide said UCO stream and taking said UCO feedstock from said UCO stream.

9. The process of claim 8, further comprising fractionating said UCO stream to provide said heavy UCO stream comprising said UCO feedstock.

10. The process of claim 1, further comprising at least one of:

a sensor in fluid communication with the PNA adsorbent for sensing at least one parameter; and a transmitter in communication with said device for transmitting a signal or data from the sensor.

11. A process for manufacturing a lubrication oil, the process comprising:

fractionating a UCO stream to provide a heavy UCO stream comprising a UCO feedstock and a light UCO stream and mixing said UCO feedstock with said light UCO stream to provide a lube feed stream;

contacting said UCO feedstock with a HPNA adsorbent to remove HPNA compounds having at least seven aromatic rings;

contacting said UCO feedstock with a PNA adsorbent to remove PNA compounds with five and six aromatic rings; and providing said UCO feedstock with no more than 100 wppm of five and six aromatic rings.

12. The process of claim 11, wherein the PNA adsorbent and the HPNA adsorbent are activated carbons.

13. The process of claim 12, wherein said HPNA adsorbent is contacted with said UCO feedstock before said PNA adsorbent is contacted with said UCO feedstock.

14. The process of claim 11, further comprising contacting a hydrocarbon feed stream with hydrocracking catalyst to provide a hydrocracked stream and fractionating said hydrocracked stream to provide said UCO stream from which said UCO feedstock is taken.

15. A process for manufacturing a lubrication oil, the process comprising:

contacting a hydrocarbon feed stream with hydrocracking catalyst to provide a hydrocracked stream and fractionating said hydrocracked stream to provide a UCO stream;

fractionating said UCO stream to provide a heavy UCO stream and a light UCO stream:

taking one of said heavy UCO stream and said light UCO stream as a UCO feedstock; contacting said UCO feedstock with a PNA adsorbent to remove PNA compounds with five and six aromatic rings; and providing a treated UCO feedstock with no more than 100 wppm of five and six aromatic rings.

16. The process of claim 15, further comprising taking said heavy UCO stream as said UCO feedstock and contacting said UCO feedstock with a HPNA adsorbent to remove HPNA compounds having at least seven aromatic rings.

17. The process of claim 16, wherein said UCO feedstock is contacted with said HPNA adsorbent before said UCO feedstock is contacted with said PNA adsorbent.

18. The process of claim 15, further comprising taking said light UCO stream as said UCO feedstock and contacting said heavy UCO stream with a HPNA adsorbent to remove HPNA compounds having at least seven aromatic rings.

* * * * *